US011020679B1

(12) United States Patent
Sledge et al.

(10) Patent No.: US 11,020,679 B1
(45) Date of Patent: Jun. 1, 2021

(54) ROTATING FLIPPING AND GRASPING MOVEMENTS IN MECHANICAL TOYS

(71) Applicants: Rory T Sledge, O'Fallon, IL (US); Michael S Gramelspacher, Carrolton, IL (US)

(72) Inventors: Rory T Sledge, O'Fallon, IL (US); Michael S Gramelspacher, Carrolton, IL (US)

( * ) Notice: Subject to any disclaimer, the term of this patent is extended or adjusted under 35 U.S.C. 154(b) by 22 days.

(21) Appl. No.: 16/696,584

(22) Filed: Nov. 26, 2019

Related U.S. Application Data

(60) Provisional application No. 62/771,976, filed on Nov. 27, 2018.

(51) Int. Cl.

| | |
|---|---|
| ***A63H 13/00*** | (2006.01) |
| ***A63H 33/00*** | (2006.01) |
| *A63H 3/28* | (2006.01) |
| *A63H 3/00* | (2006.01) |
| *A63H 3/40* | (2006.01) |

(52) U.S. Cl.
CPC ..... *A63H 13/005* (2013.01); *A63H 33/005* (2013.01); *A63H 3/006* (2013.01); *A63H 3/28* (2013.01); *A63H 3/40* (2013.01)

(58) Field of Classification Search
CPC .... A63H 33/005; A63H 33/003; A63H 13/00; A63H 11/00; A63H 11/02; A63H 17/004; A63H 13/005; B25J 9/0003
See application file for complete search history.

(56) References Cited

U.S. PATENT DOCUMENTS

| | | | | |
|---|---|---|---|---|
| 1,763,903 | A * | 6/1930 | Perkins | A63H 15/06 446/273 |
| 2,189,759 | A * | 2/1940 | Lohr | A63H 13/02 446/290 |
| 3,262,700 | A * | 7/1966 | Miller | A63B 37/0001 472/54 |
| 4,291,490 | A * | 9/1981 | Ikeda | A63H 11/00 446/90 |
| 4,671,779 | A | 6/1987 | Kurosawa | |
| 5,720,644 | A * | 2/1998 | Ku | A63H 11/00 446/175 |
| 6,149,490 | A | 11/2000 | Hampton | |
| 6,736,693 | B1 | 5/2004 | Lund | |
| 6,773,327 | B1 * | 8/2004 | Felice | A63H 13/02 446/330 |
| 7,270,590 | B2 | 9/2007 | Marine | |
| 8,197,298 | B2 * | 6/2012 | Willett | A63H 33/005 446/164 |
| 8,702,468 | B2 * | 4/2014 | Walterscheid | A63H 3/46 446/390 |

(Continued)

*Primary Examiner* — Eugene L Kim
*Assistant Examiner* — Alyssa M Hylinski
(74) *Attorney, Agent, or Firm* — Linda L Lewis

(57) ABSTRACT

A mechanical toy incorporating structures that coordinate the positioning and movement of specific body parts for rotating, flipping and grasping movements with programmable systems, methods, and devices within toy structures. Extensions connected to opposite sides of a motive body or head assembly including grasping members and support structures for rotating and/or turning actions about a central body portion including grasping appendages. The toy apparatus may also interact with accessory items to enhance play value.

19 Claims, 21 Drawing Sheets

(56) References Cited

U.S. PATENT DOCUMENTS

| | | | | |
|---|---|---|---|---|
| 8,894,465 | B2 * | 11/2014 | McClintock | A63H 33/005 446/431 |
| 10,478,971 | B2 * | 11/2019 | Ogawa | A63H 11/00 |
| 2002/0055320 | A1 * | 5/2002 | An | A63H 13/005 446/268 |
| 2004/0192163 | A1 * | 9/2004 | Siegel | A63B 43/04 446/486 |

* cited by examiner

SPIN
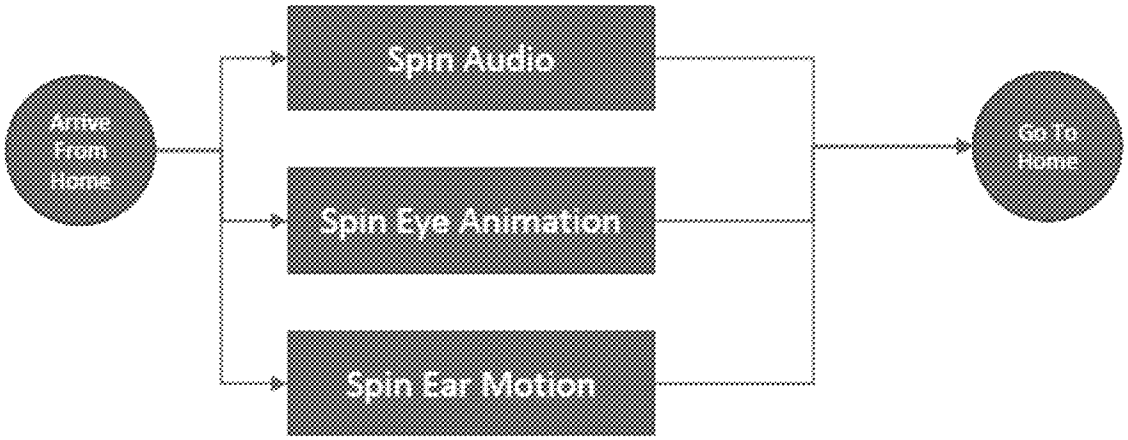
FIG. 10
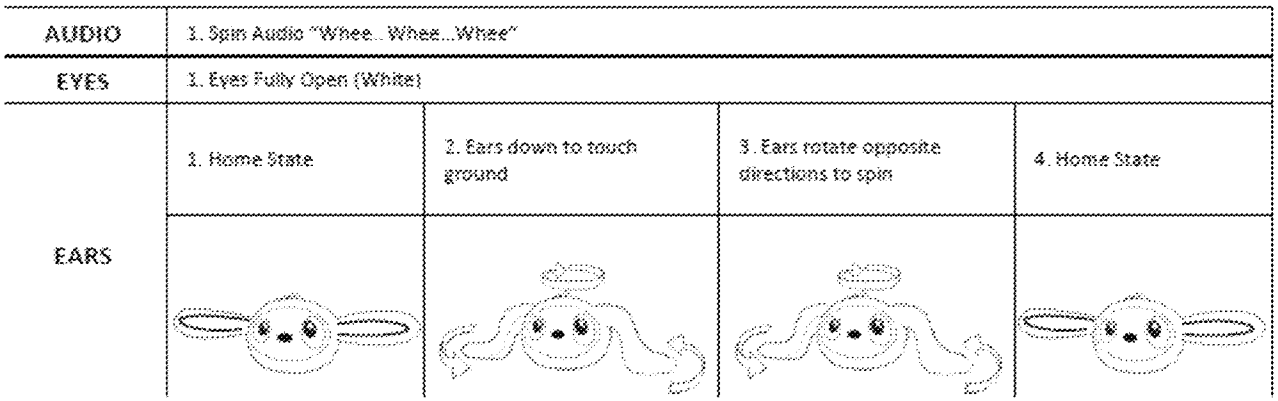

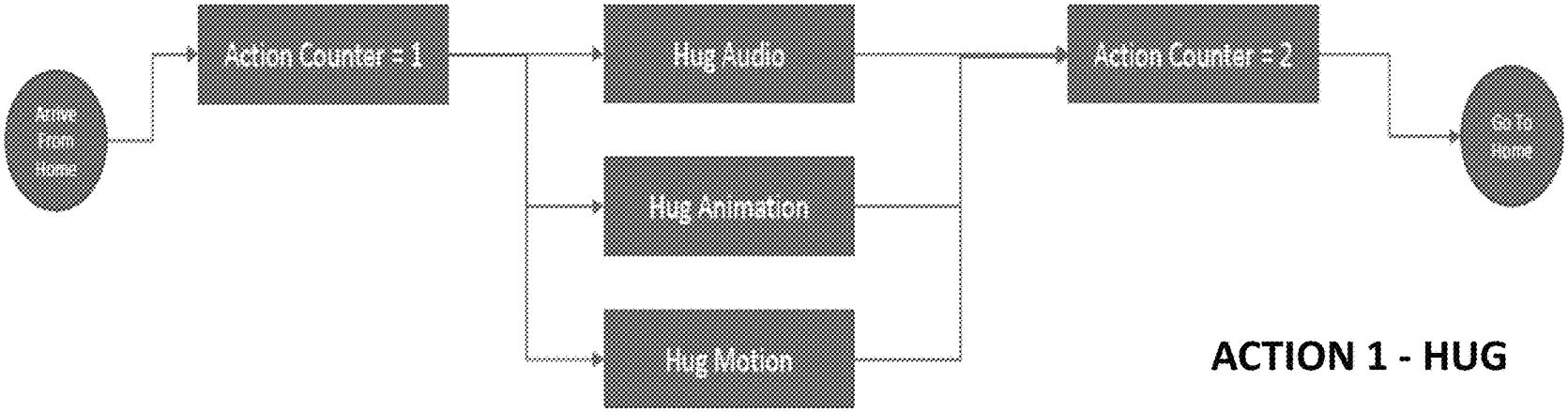
ACTION 1 - HUG
Fig. 14
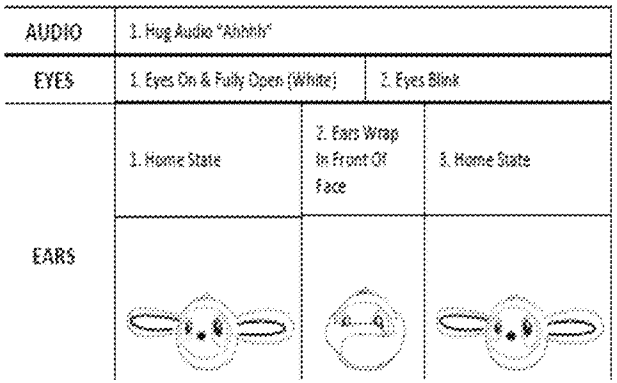

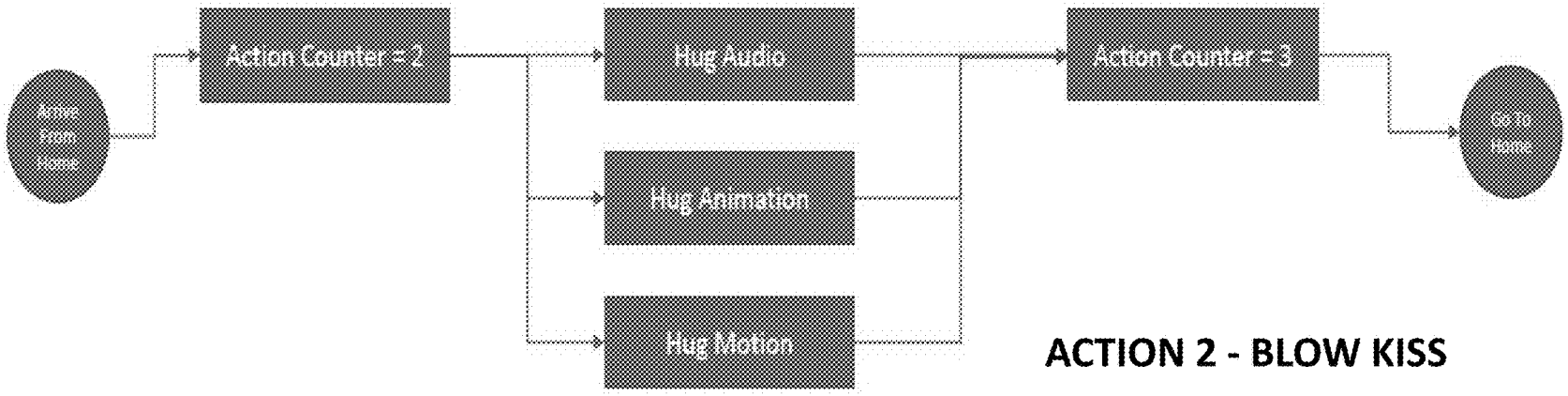
ACTION 2 - BLOW KISS
Fig. 15
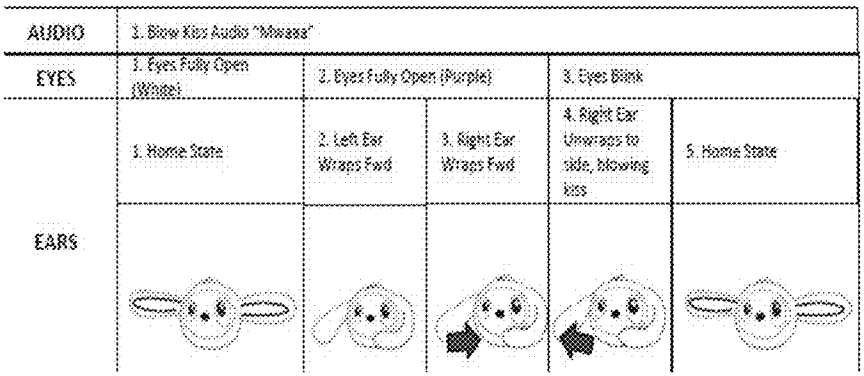

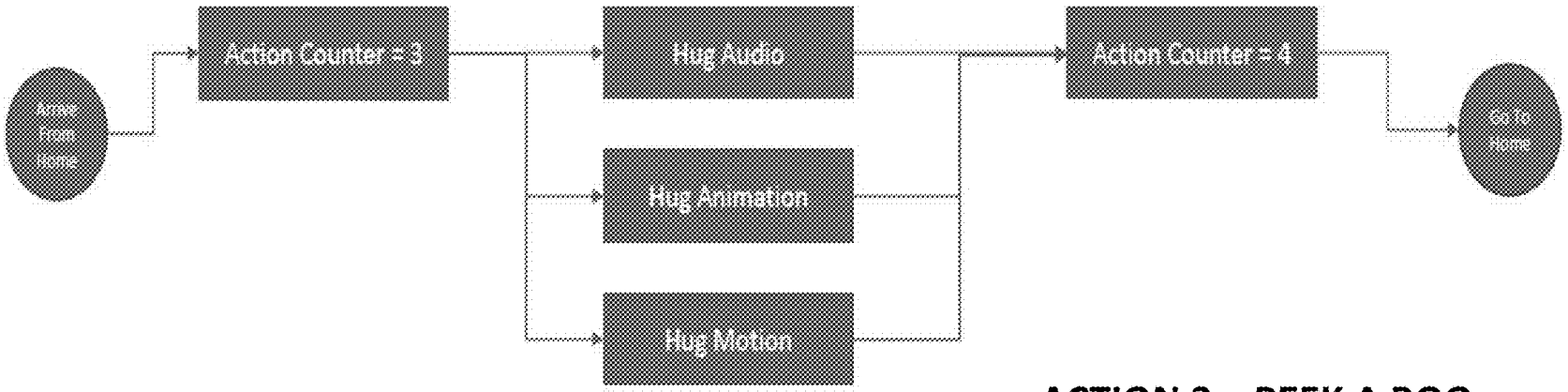
ACTION 3 – PEEK A BOO
FIG. 16
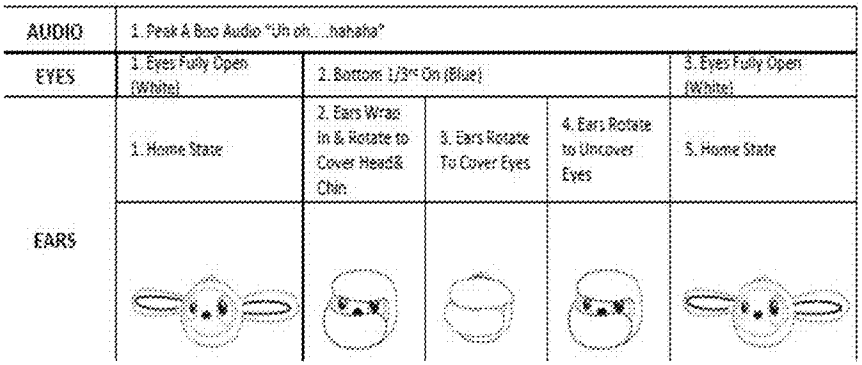

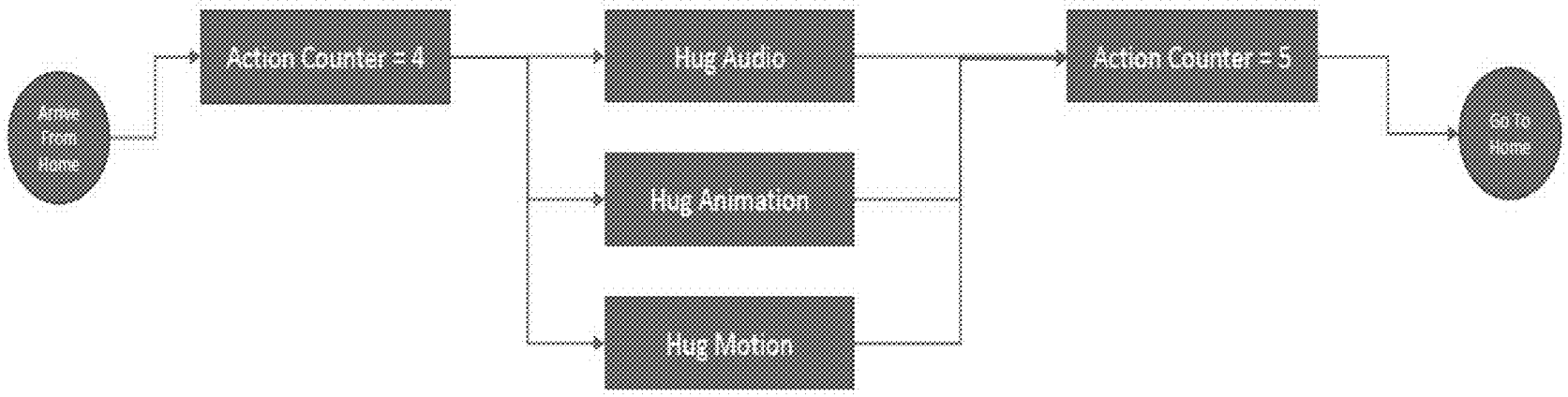
ACTION 4 – DRUM SOLO
FIG. 17
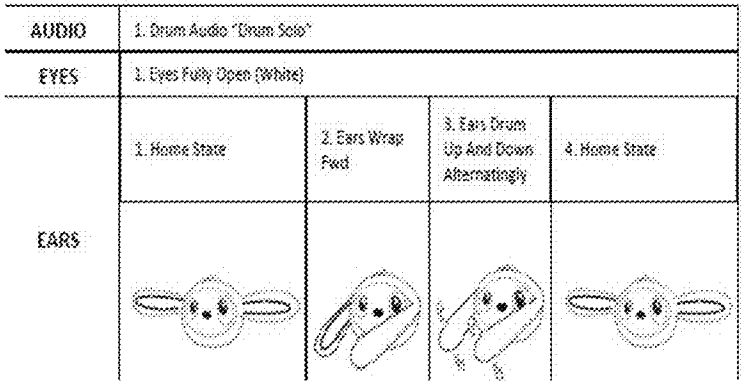

ACTION 5 - CLAPPING

| AUDIO | 1. Clapping Audio "Crowd Cheering" | | | | | |
|---|---|---|---|---|---|---|
| EYES | 1. Eyes Fully Open (White) | 2. Eyes Blink | 3. Eyes Fully Open (White) | | | |
| EARS | 1. Home State | 2. Ears Rotate To Face Upward | 3. Ears Wrap Inward to Clap | 4. Ears Unwrap Slightly | 5. Ears Wrap Inward to Clap | 6. Home State |

ACTION – 6 YAWN

| AUDIO | 1. Yawn Audio "Yawn" | | | |
|---|---|---|---|---|
| EYES | 1. Eyes Fully Open (White) | 2. Bottom 1/3rd Open (Blue) | | 3. Eyes Fully Open (White) |
| EARS | 1. Home State | 2. Ears Rotate Downward | 3. Ears Wrap Downward Slightly | 4. Home State |

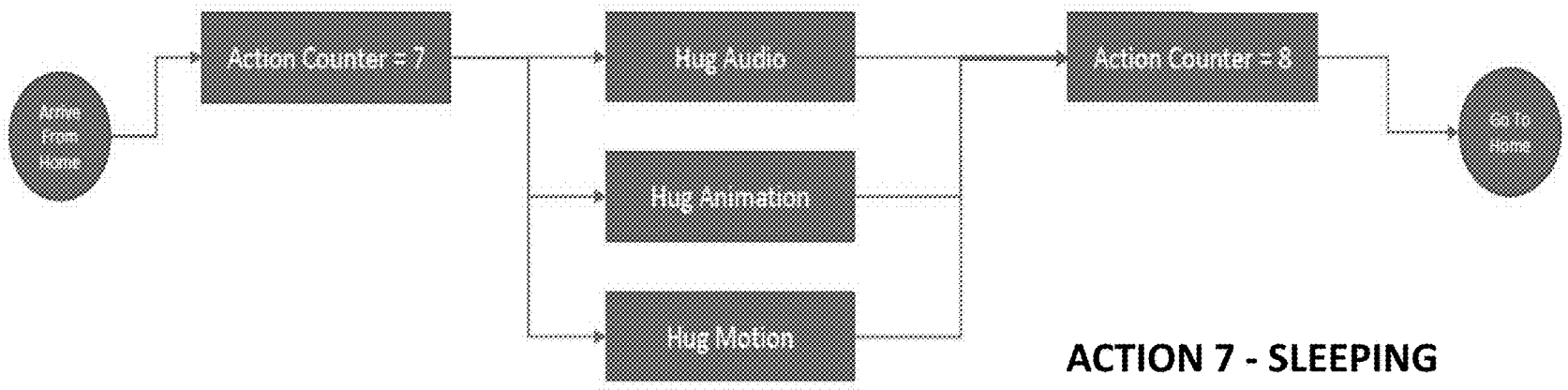
ACTION 7 - SLEEPING
FIG. 20
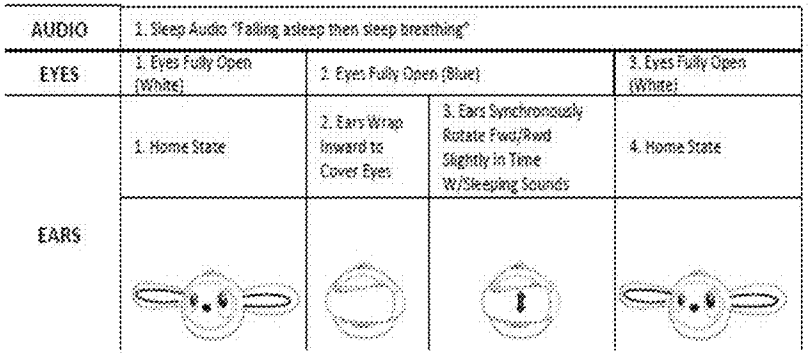

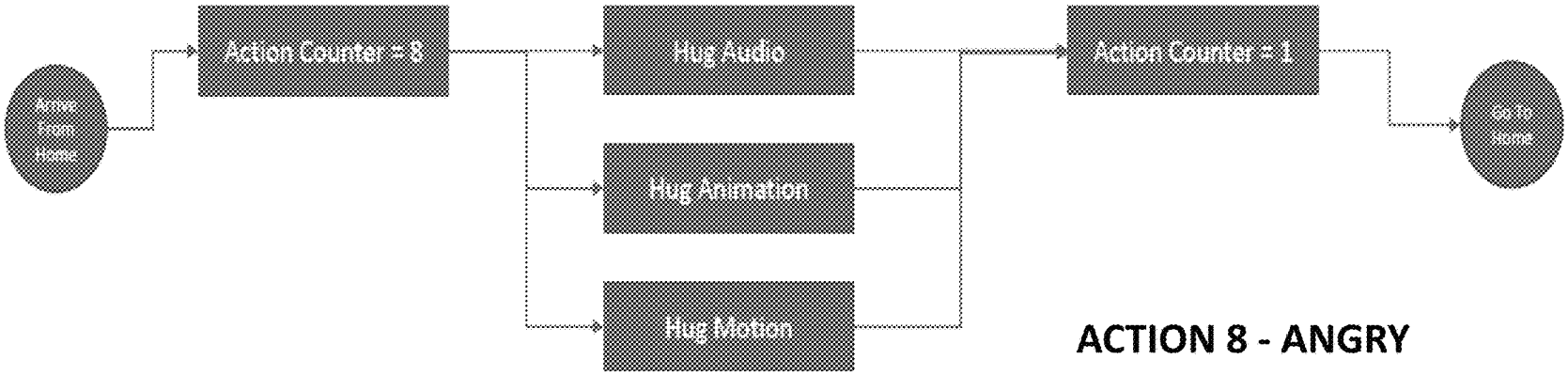
ACTION 8 - ANGRY
FIG. 21
| AUDIO | 1. Angry Audio "Grrrrr" | | | |
|---|---|---|---|---|
| EYES | 1. Eyes Fully Open (White) | 2. Bottom 2/3rd On (Red) | | 3. Eyes Fully Open (White) |
| | 1. Home State | 2. Ears Wrap Fwd | 3. Ears Synchronously Rotate Fwd/Rwd Slightly To Hit Ground | 4. Home State |
| EARS | 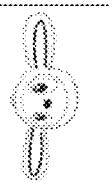 | 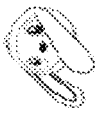 | 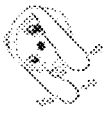 |  |

ROTATING FLIPPING AND GRASPING MOVEMENTS IN MECHANICAL TOYS

CROSS-REFERENCE TO RELATED APPLICATIONS

This application claims priority from U.S. Provisional Patent Application No. 62/771,976 filed Nov. 27, 2018 which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to toy robots, and more particularly to entertaining robotic toy doll that provides locomotion and manipulation with a single mechanism. The toy robot has movable and programmable appendages, such as the doll's arms, or appendages about its head or body, including electromechanical toys coordinating the positioning and movement of specific body parts. The toy apparatus may also interact with accessory items to enhance play value.

Related Art

Similar to most fields, the toy industry is always striving for the next best thing. Ideas and products need to be fresh and inventive, displaying added features and abilities over their predecessors. Many kinds of toys exist and are designed for the amusement of children and adults alike. With movable toy dolls are known including dolls having various moveable features operated by a processor. For example, U.S. Patent Application Publication number 2006/0270312, entitled Interactive Animated Characters and listing Maddocks, Rodriquez, Ford and Hall as inventors, purports to disclose an interactive animated toy character that uses a processor, a motor, a control shaft, and multiple cams and cam followers to move eyes, eye lids, mouth, brow, ears, plume, chest and feet of the character, which is illustrated as a furry doll marketed under the brand FURBY®. The cams are provided with precise predetermined shapes, which are coordinated by the processor's programming. In this manner the character may be provided with multiple different predetermined physical and emotional expressions, including those responsive to input from a child. The input may be in the form of holding the toy, and/or petting and tickling the toy. For example, the child is able to pet the toy's tummy, rub its back or rock it and embedded sensors communicate these motions to the processor. Further means are known in the art for creating the illusion of animation in the faces of toy characters in order to provide an enriched user experience for the user, including LED light eyes or face illumination of animation facial illusion with lights are positioned relative to a screen.

In addition to the Application Publication of the previous paragraph, relevant disclosures may exist in earlier patents identified in the Application Publication, including U.S. Pat. Nos. 6,149,490; 6,497,607; 6,514,117; 6,537,128; and 6,544,098 all of which concern the FURBY® toy identified above.

U.S. Pat. No. 6,736,693 to Lund et al. for "Rolling and standing toy doll" issued May 18, 2004 is directed to a doll that includes a pair legs pivotally attached to a torso. A pair of motor mechanisms are separately attached to each leg for pivoting the legs forwards and backwards in accordance to a set of pre-programmed positions that moves the doll from a first orientation to a second orientation. Likewise U.S. Pat. No. 7,270,590 to Marine et al. for "Assisted walking dolls and joint assemblies for use with same" issued Sep. 18, 2007 discloses movements such as rolling the doll from its front side to its backside and vice versa, as well as moving the doll to a standing position and walking the doll while it is standing. Self-righting and self-tipping toy vehicles are also known in the art. One common concept of the prior art has been to provide an arm which either pivots or rotates to engage the supporting surface and effect either righting, or tipping, of the vehicle. For example, the U.S. patents to Westberg U.S. Pat. No. 1,846,823, Shinohara U.S. Pat. No. 4,363,187, Fisher U.S. Pat. No. 4,449,323, Nagano U.S. Pat. No. 4,666,420 and Kamikawa U.S. Pat. No. 4,894,042 disclose such devices. Toy wheeled vehicles are well-known. One class of known toy vehicles includes chassis or chassis/body combinations that are or have linkages permitting parts of the chassis or chassis/body combination to flex and allow the vehicle to change its configuration. The prior art, for example U.S. Pat. Nos. 4,597,744; 4,626,223 and 4,813,906, discloses vehicles comprised of multiple links capable of pivoting with respect to one another. U.S. Pat. No. 4,671,779 discloses a motorized running toy wherein multiple linkages forming a flexible tail-like structure may be collapsed about a drum-like main portion of the toy having a central axis or extended axially from the drum-like portion of the toy having the central axis. U.S. Pat. No. 6,773,327, issued to an assignee of Felice and Maddocks in 2004 for an Apparatus for Actuating a Toy, purports to describe a toy with movable limbs structured with a flexible strip and two elongated cords, one to each side of the strip, where both cords are connected to two arms of a motor. When the motor rotates in one direction and then the other direction compound movements of the limbs are achieved. Further known prior art includes manually activated appendages which contract in a grasping manner as disclosed in U.S. Pat. No. 5,378,188 entitled "Tendon and Spring for Toy Actuation" to Clark et al., issued Jan. 3, 1995. The '188 patent incorporates a doll, capable of a free-standing position. When the doll's torso is compressed, the upper appendages curl inward and the lower appendages rise upwards, removing the dolls free-standing ability. By releasing the doll, the upper and lower appendages are motivated to their original positions. U.S. Pat. No. 5,297,443 to Wentz for "Flexible positioning appendage" issued Mar. 29, 1994 relates to flexible appendages e.g. for use as a controllable robot arm, toy or the like having flexibly coupled segments.

Various other known apparatus and configurations exist but do not facilitate a mechanical platform, system or methods of electromechanical toy robots with programmed appendages entertaining robotic toy doll with coordinated movements. Significantly it is unknown to coordinate the positioning and movement of specific body parts for rotating, flipping and grasping movements therewith manipulated by the user.

It would be desirable to provide electromechanical toy robots with appendages and coordinated movements thereof for rotating, flipping and/or grasping movements in toys.

SUMMARY OF THE INVENTION

The present invention addresses shortcomings of the prior art to provide electromechanical toy robots with programmed appendages to coordinate the positioning and movement of specific body parts for rotating, flipping and grasping movements with the toy manipulated by the user. The appendages connected to opposite sides of a motive body or head assembly including grasping members and support structures for rotating and/or turning actions about a central body portion including grasping appendages. As disclosed, the toy may also interact with the user or accessory items to enhance play value.

Briefly summarized, the present invention relates to toys having structures that coordinate the positioning and movement of specific body parts appendage or limb controlled motion (via the arm/ear hybrid limbs) for rotating, flipping and grasping movements with programmable systems, methods, and devices within toy structures, including the mechanism's ability to turn, move directionally, and roll the character, as well as grab objects, without the assistance of a traditional walking mechanism or wheels.

The present invention is a mechanical toy device that provides locomotion and manipulation with one mechanism. The mechanical toy device comprises a body and at least two extensions, wherein the at least two extensions are opposed to each other and wherein the body has an interior, a front, a back, a top, a bottom, two sides and a bisecting plane between the two sides. The front, top and back are approximately continuously curved to facilitate rolling and the bottom is approximately flat to facilitate sitting upright. Located on two sides are attachment points for the two extensions, one on each side, and wherein the two opposing extensions attachment points form a horizontal axis when the mechanical toy is sitting upright. The two opposing extensions each have a proximate end located at the attachment point and a distal end, and the distance from proximate end to the distal end of the two opposing extensions is greater than the distance from the attachment point to the bottom, top or sides of the body. Housed in the interior of the body is a first reversible drive motor having a first drive shaft and a second reversible drive motor having a second drive shaft. The first reversible drive motor is rotatably attached to the two opposing extensions causing the at least two extensions to rotate along the horizontal axis 360 degrees. The torque of the first reversible drive motor is sufficient to roll the body when the first reversible drive motor is activated and at least one extension is not pivoting to provide locomotion of the mechanical toy device. The second reversible drive motor is coupled to the proximate ends of the two opposing extensions and provides a bilateral motion and a unilateral motion. The bilateral motion moves two of the at least two opposing extensions and the unilateral motion moves one of the at least two opposing extensions. Both the bilateral and the unilateral motion have a first portion and a second portion. The first portion pivots the at least one extension at the attachment point about a perpendicular axis which perpendicular to the horizontal axis and wherein the pivot is approximate 90 degrees from the side. The second portion causes the extension or extensions to curve toward the bisecting plane. The first reversible drive motor and the second reversible drive motor provide motion that effects manipulation. Electronically attached to the first reversible drive motor and the second reversible drive motor is a programmable microprocessor programmed to drive the first reversible drive motor and the second reversible drive motor to provide locomotion and manipulation.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

FIG. 10 is a flowchart for Spin with illustrations.

FIG. 14 is a flowchart for Action 1—Hug with illustrations.

FIG. 15 is a flowchart for Action 2—Blow Kiss with illustrations.

FIG. 16 is a flowchart for Action 3—Peek A Boo with illustrations.

FIG. 17 is a flowchart for Action 4—Drum Solo with illustrations.

FIG. 20 is a flowchart for Action 7—Sleeping with illustrations.

FIG. 21 is a flowchart for Action 8—Angry with illustrations.

The present invention will become more fully understood from the detailed description and the accompanying drawings, wherein: FIGS. 1 and 2 disclose the basic structure of the mechanical toy device. FIGS. 3 and 4 illustrate an embodiment of the two motor configured mechanical toy device that provides both locomotion and manipulation in one mechanism. This configuration is used as a toy figure such as a toy animal incorporating structures that coordinate the positioning and movement of specific body parts for rotating, flipping and grasping movements with programmable systems, methods, and devices within toy structures. With reference to FIGS. 6 through 21, Actions are illustrated in the flow charts of FIGS. 6 through 12, with Actions Button cycles illustrated starting with flow charts of FIGS. 13 through 21.

DETAILED DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention. Likewise, a reasonably broad scope for claimed or covered subject matter is intended. Among other things, for example, subject matter may be embodied as methods, devices, components, or systems. The following detailed description is, therefore, not intended to be taken in a limiting sense. Other apparatus, methods, features and advantages will be, or will become, apparent to one with skill in the art upon examination of the following figures and detailed description. It is intended that all such additional structures, methods, features and advantages are within the scope of the inventions. Nothing in this section should be taken as a limitation on the claims. Further aspects and advantages are discussed below.

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
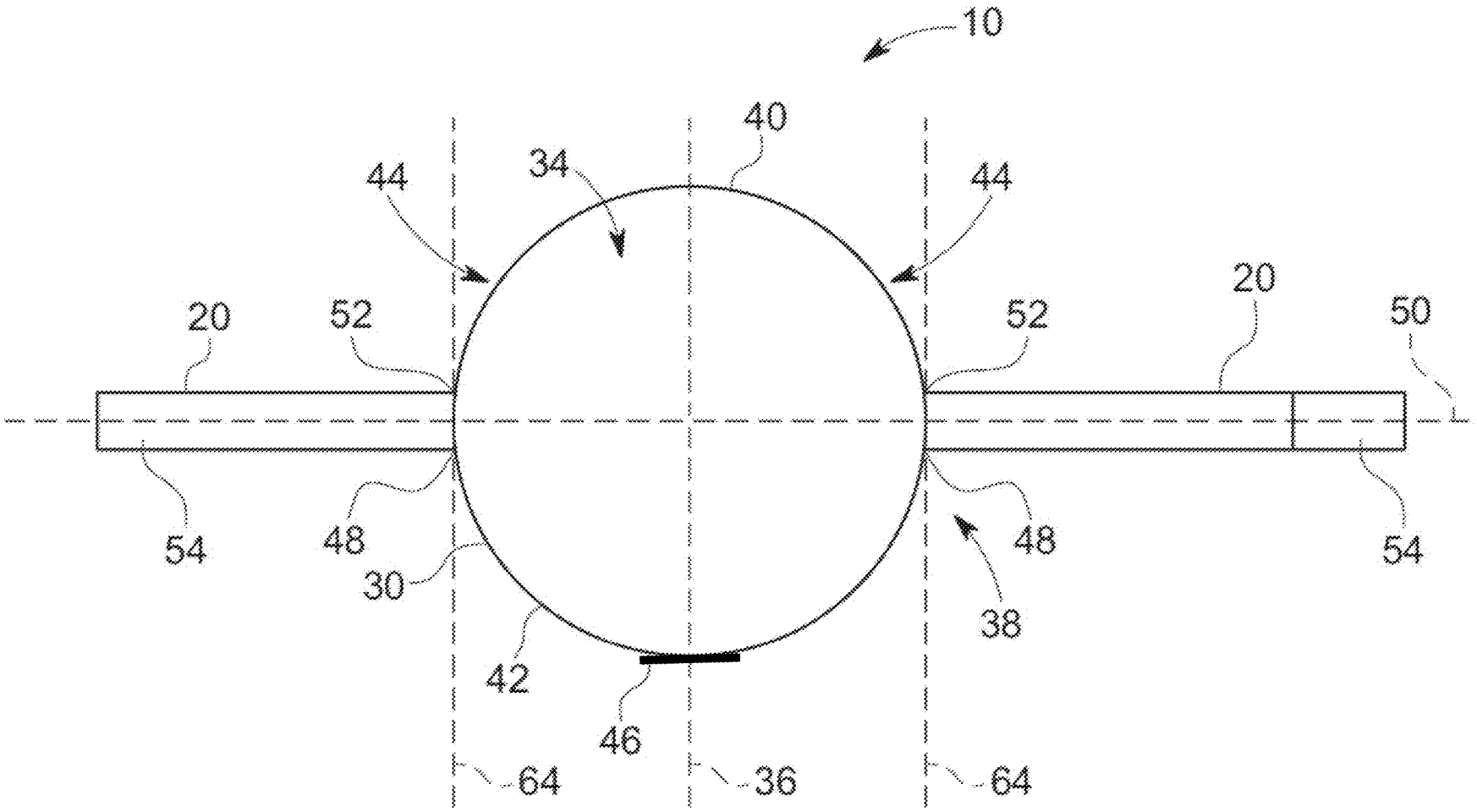
FIG. 1 is a front perspective of the mechanical toy device.
Figure 2:
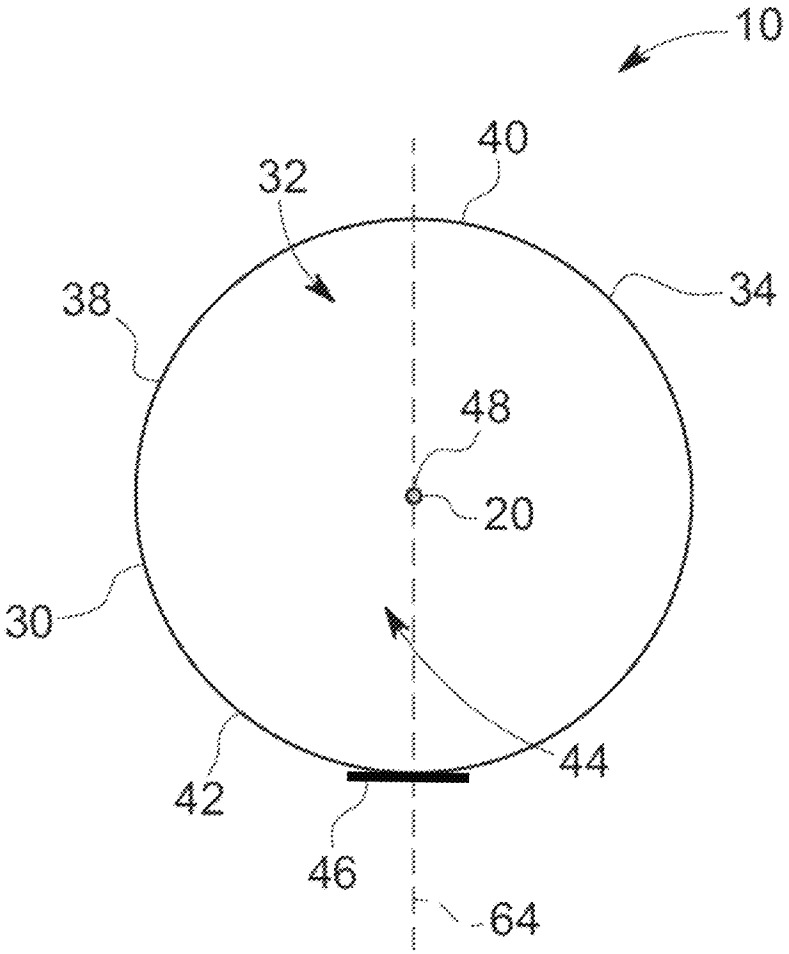
FIG. 2 is a side perspective of the mechanical toy device.

Referring to FIGS. 1 and 2, the mechanical toy device 10 has a body 30 and at least two extensions 20 wherein the at least two extensions are placed on opposite sides of the body 30. The body 30 has an interior 32, a front 34, a back 38, a top 40, a bottom 42, two sides 44 and a bisecting plane between the two sides 36. The front, top and back are approximately continuously curved to facilitate rolling and the bottom 42 has an approximately flat portion 46 to facilitate sitting upright. Located on two sides 44 are attachment points 48 for the two extensions, one on each side. The two opposing extensions attachment points form a horizontal axis 50 when the mechanical toy is sitting upright. The two opposing extensions 20 each have a proximate end 52 located at the attachment point and a distal end 54, and the distance from proximate end to the distal end of the two opposing extensions is greater than the distance from the attachment point to the bottom of the body.

Housed in the interior 32 of the body is a first reversible drive motor 60 having a first drive shaft 61 and a second reversible drive motor 62 having a second drive shaft 63. The first reversible drive motor is rotatably attached to the two opposing extensions causing the at least two extensions to rotate along the horizontal axis 360 degrees. The second reversible drive motor is coupled to the proximate ends of the two opposing extensions and provides a bilateral motion and a unilateral motion. The bilateral motion moves two of the at least two opposing extensions and the unilateral motion moves one of the at least two opposing extensions. Both the bilateral and the unilateral motion have a first portion and a second portion. The first portion pivots the at least one extension at the attachment point about a perpendicular axis 64 which is perpendicular to the horizontal axis and wherein the pivot is approximate 90 degrees from the side. The second portion causes the extension or extensions to curve toward the bisecting plane. Electronically attached to the first reversible drive motor and the second reversible drive motor is a programmable microprocessor (not shown) programmed to start, stop, control the direction and speed of the first reversible drive motor and the second reversible drive motor.

Figure 3:
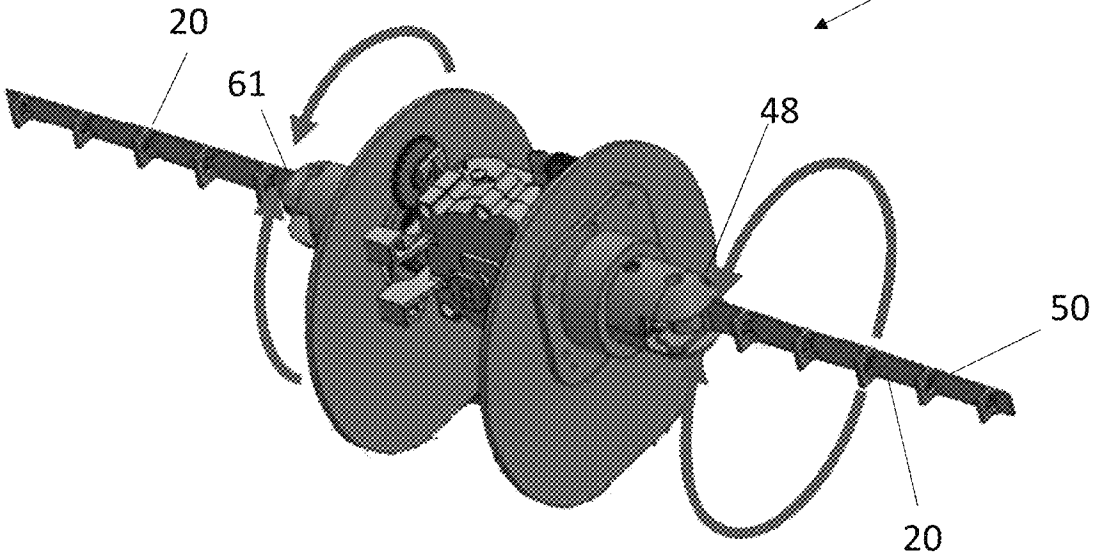
FIG. 3 is an iso view of an embodiment of the mechanical toy device showing the rotation of the first reversible drive motor.

The preferred embodiment of the invention is a two drive motor design. In a preferred embodiment, the first reversible drive motor 60 is embodied in FIG. 3. The first reversible drive motor rotation motion can be tracked using a potentiometer or PCB wiper system. As shown in FIG. 3, the reversible drive motor creates a reversible rotation in the at least two extensions that is indicated by curved arrows.

Figure 4:
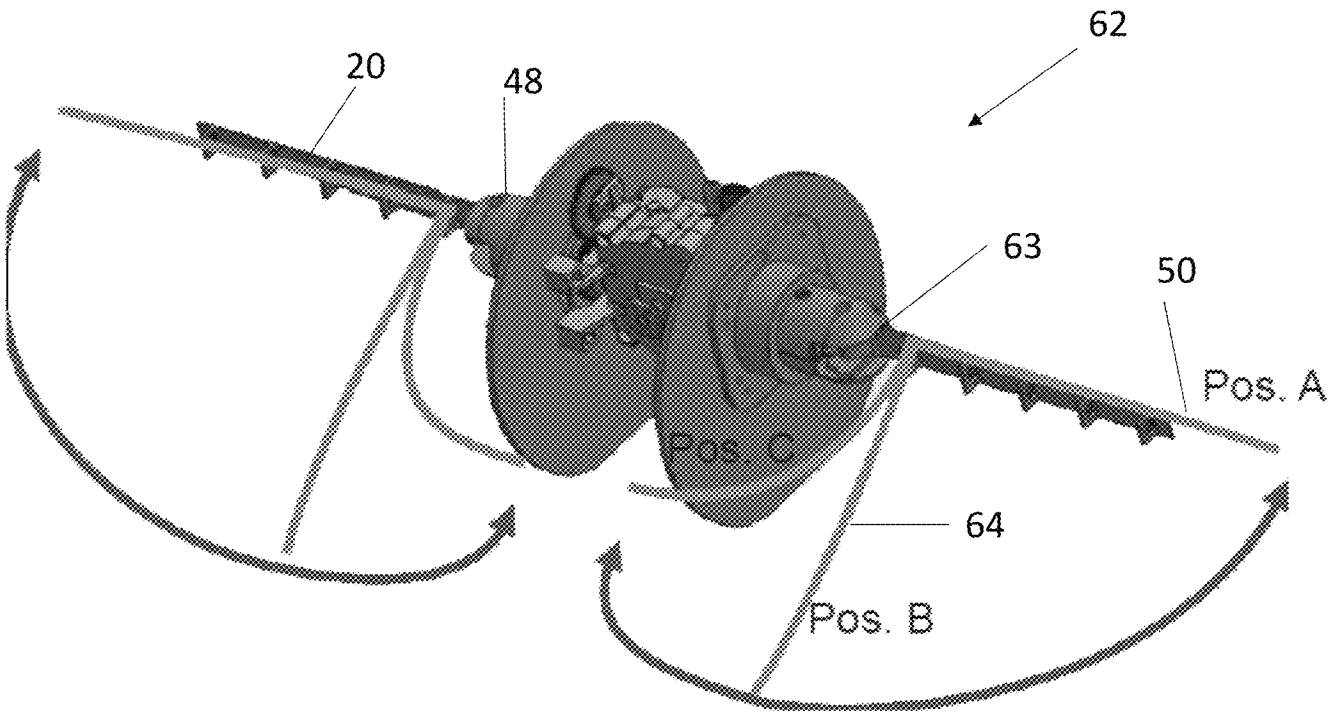
FIG. 4 is an iso view of an embodiment of the mechanical toy device showing the pivoting of the second reversible drive motor.

In a preferred embodiment, the second reversible drive motor 62 is embodied in FIG. 4. It uses a cam system to operate a first portion and a second portion;

wherein the first portion pivots the at least one extension at the attachment point 48 about a perpendicular axis 64 which is perpendicular to the horizontal axis 50. The extension is pivoted about 90 degrees. Referring to FIG. 4, the extension pivots from position A to position B. In a preferred embodiment a gear drives the pivot point to move from position A to position B. No tension is applied to the second portion motion, as it is desirable that the at least two extensions to stay straight between position A and B. The second portion causes the extension to curve toward the bisecting plane, or from position B to position C. To actuate the movement, the pivot point gear stops turning, and tension is put on the ribbon actuator to bend and wrap the at least two extensions to position C. One half of the cam moves and bends only one extension. The other half of the cam moves and both extensions bend simultaneously. The cam wheel position can be tracked using a potentiometer or PCB wiper system.

As is known to those skilled in the art, additional drive motors can be used to provide additional movement options, such as the independent pivot movement of each extension by the addition of a third drive motor. A fourth drive motor to drive the independent rotation of each extension.

The torque of the first reversible drive motor is sufficient to be able to roll the body at its given weight distribution and body design. This provides locomotion to the mechanical toy device, so that when the first reversible drive motor is activated and at least one extension is not pivoting, the body rolls and provides locomotion. When only one extension is not pivoting, the mechanical toy device moves in a circular motion. When two or more extensions are not pivoting, the mechanical device can move either forward or reverse.

In a preferred embodiment, the mechanical toy device further takes into account the Center of Gravity (COG), accommodating its shape according to weight, dimensions and form factor. To this end, the flat bottom 46 of the body 30 is provided as shown, as being such that it can keep the body upright in a stable position. Generally, its COG is centered from front to back and left to right and slightly lower than center top to bottom, with the first and second drive motors being sufficient to flip the body wherein positioning of each of its components configured including batteries as physically centered therein to achieve rolling and novel movements. In a preferred embodiment, the at least two extensions are designed and positioned generally close to the body center of rotation, the housing rolls well and the product is aesthetically pleasing by having its extensions meet the head at a point higher than the center of rotation, while operating with the positioning of the rotating extensions accordingly.

Figure 5:
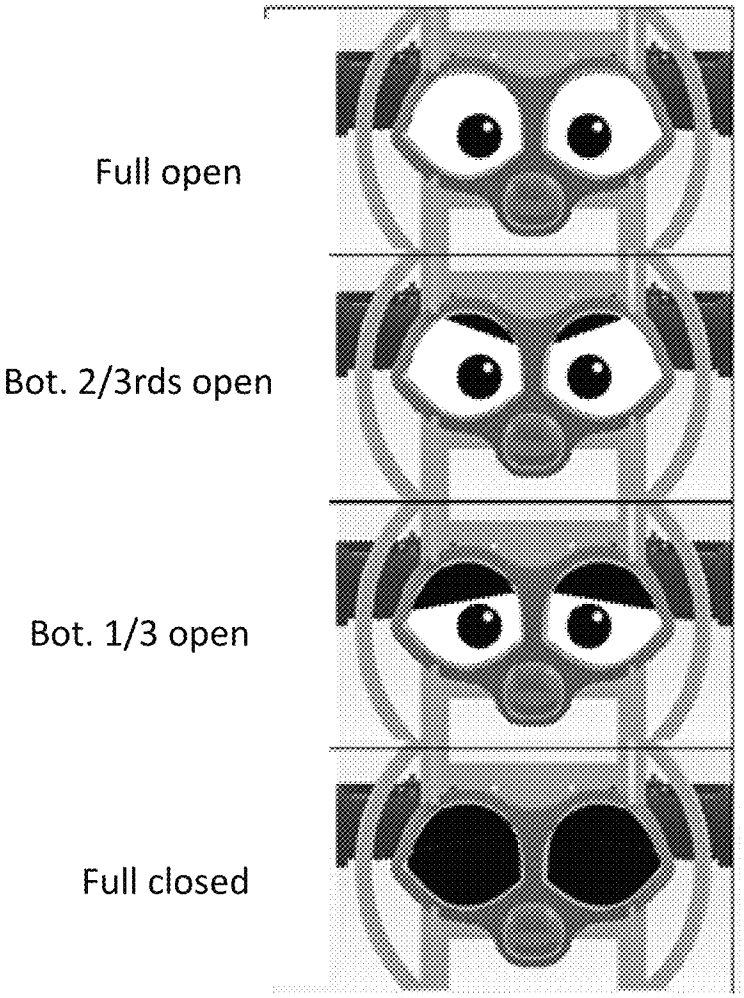
FIG. 5 is a front view of an embodiment of the eyes of the mechanical toy device.
Figure 6:
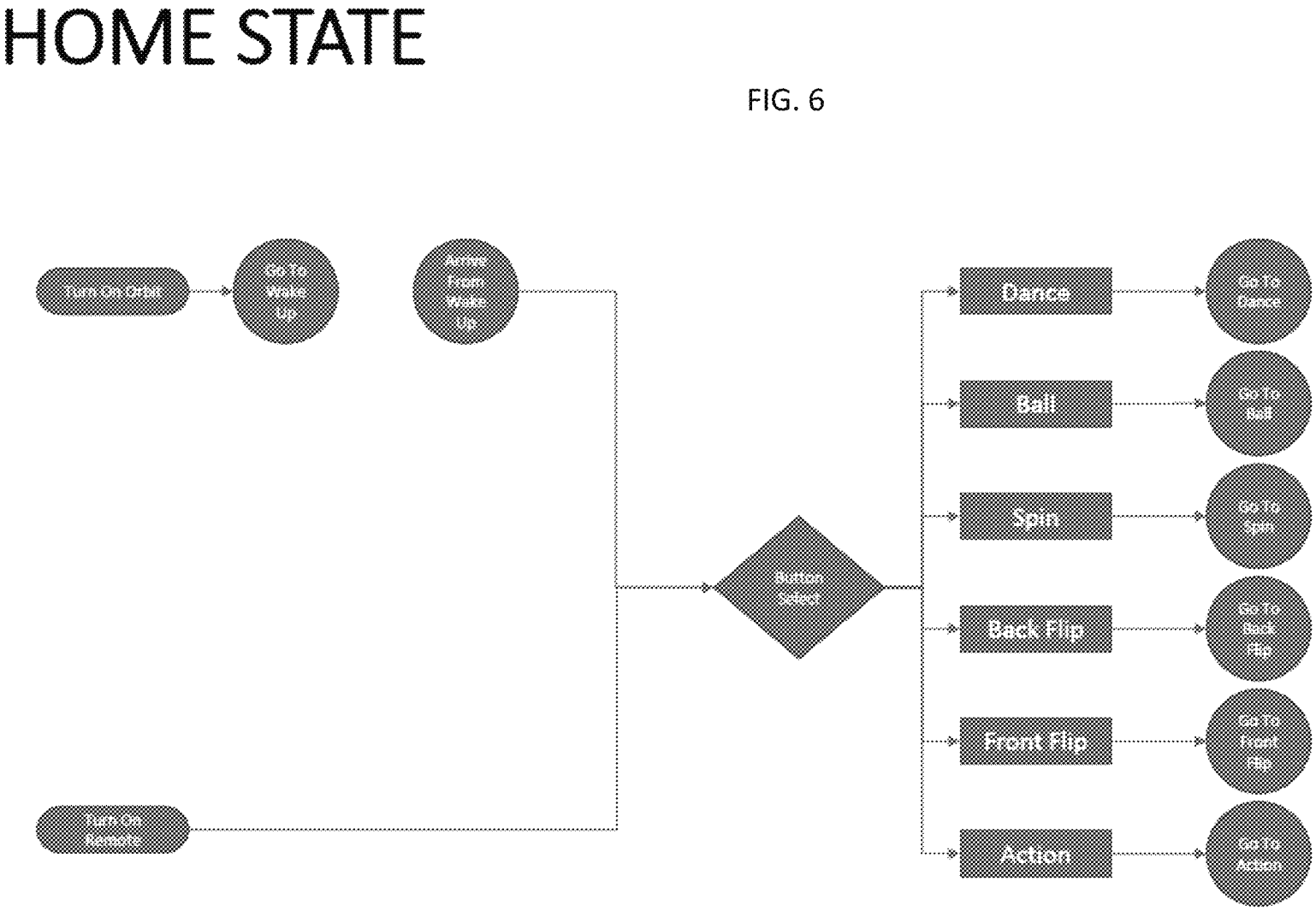
FIG. 6 is a flowchart for Home State.
Figure 7:
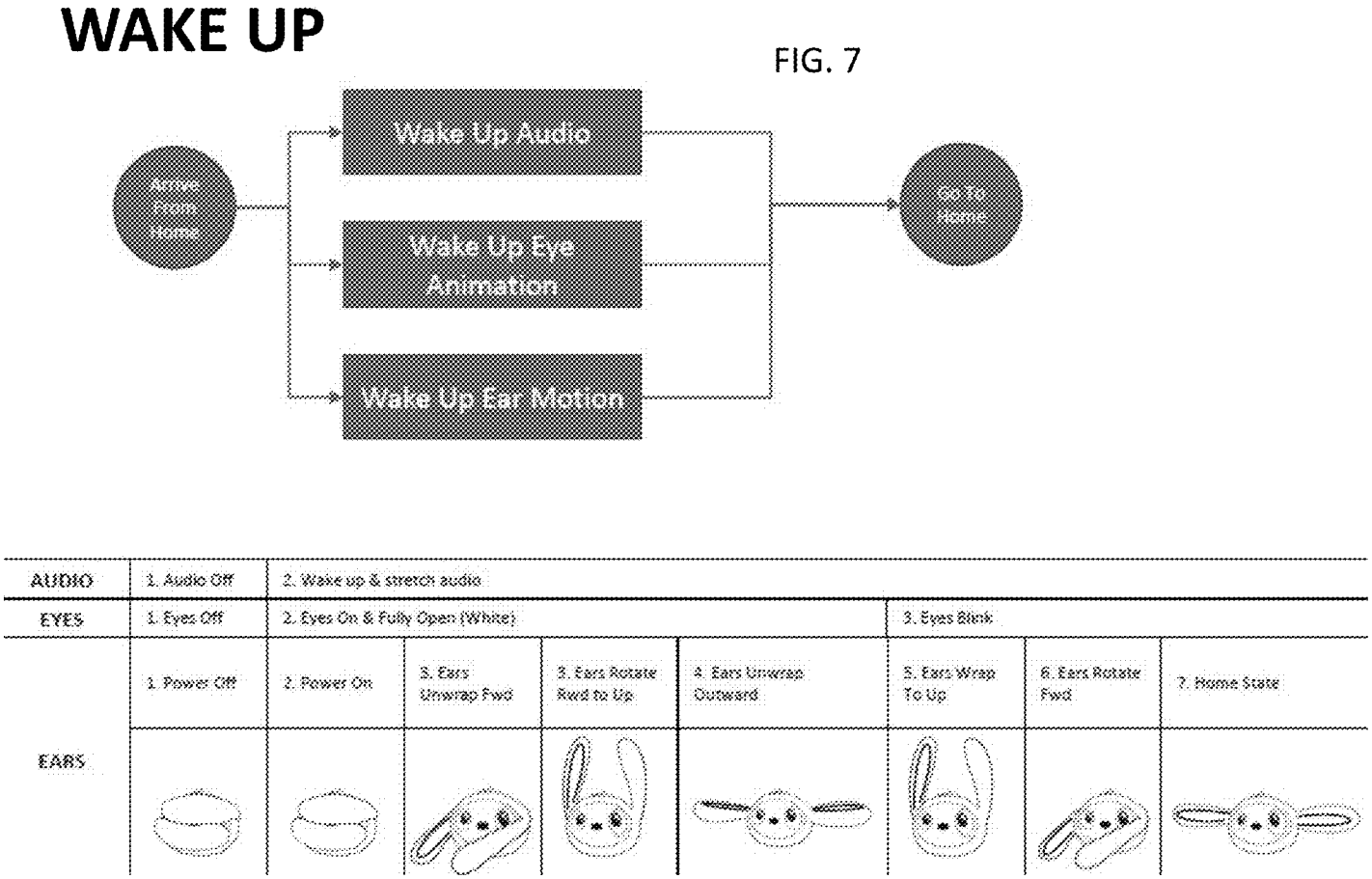
FIG. 7 is a flowchart for Wake Up with illustrations.
Figure 8:
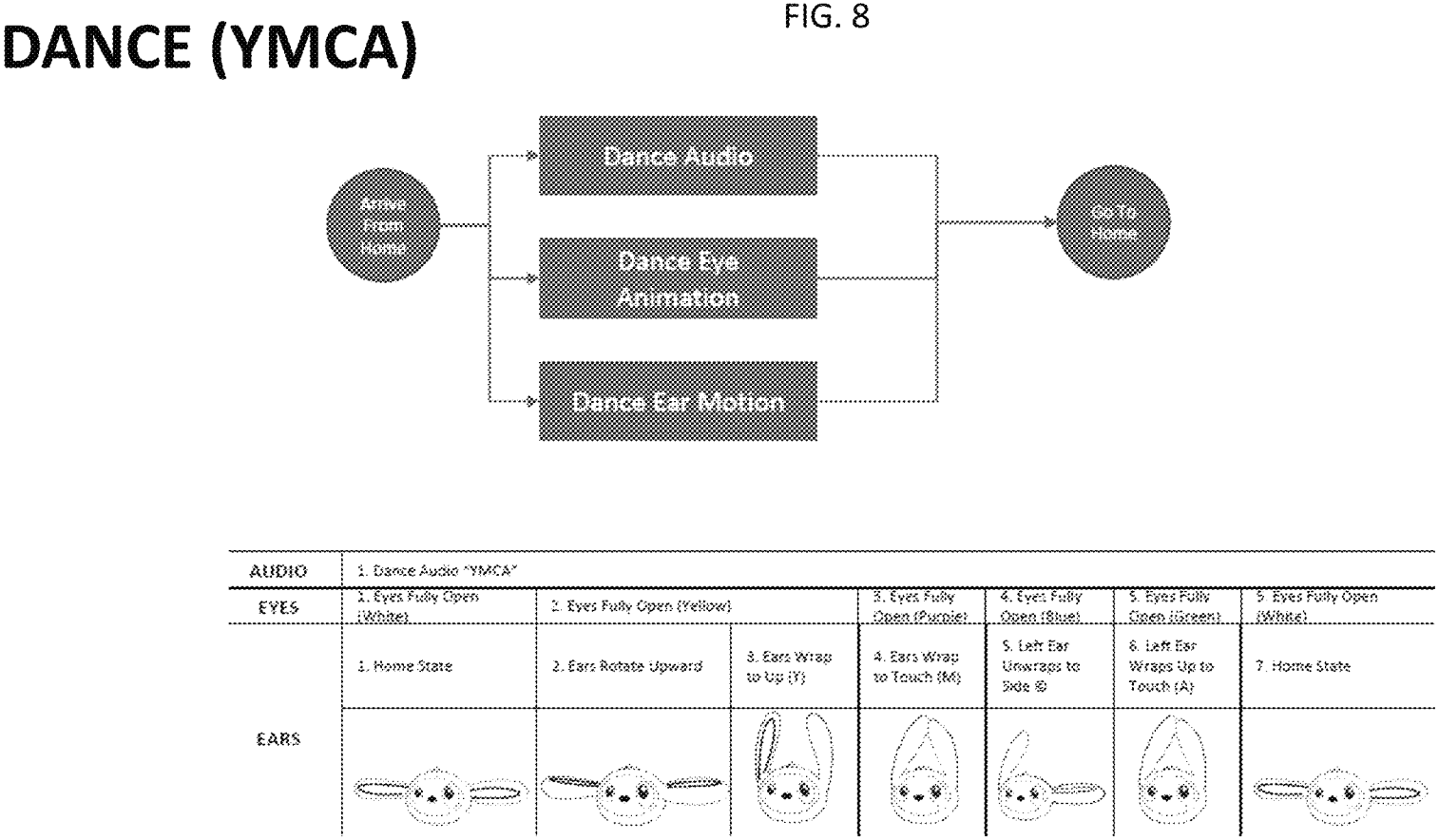
FIG. 8 is a flowchart for Dance (YMCA) with illustrations.
Figure 9:
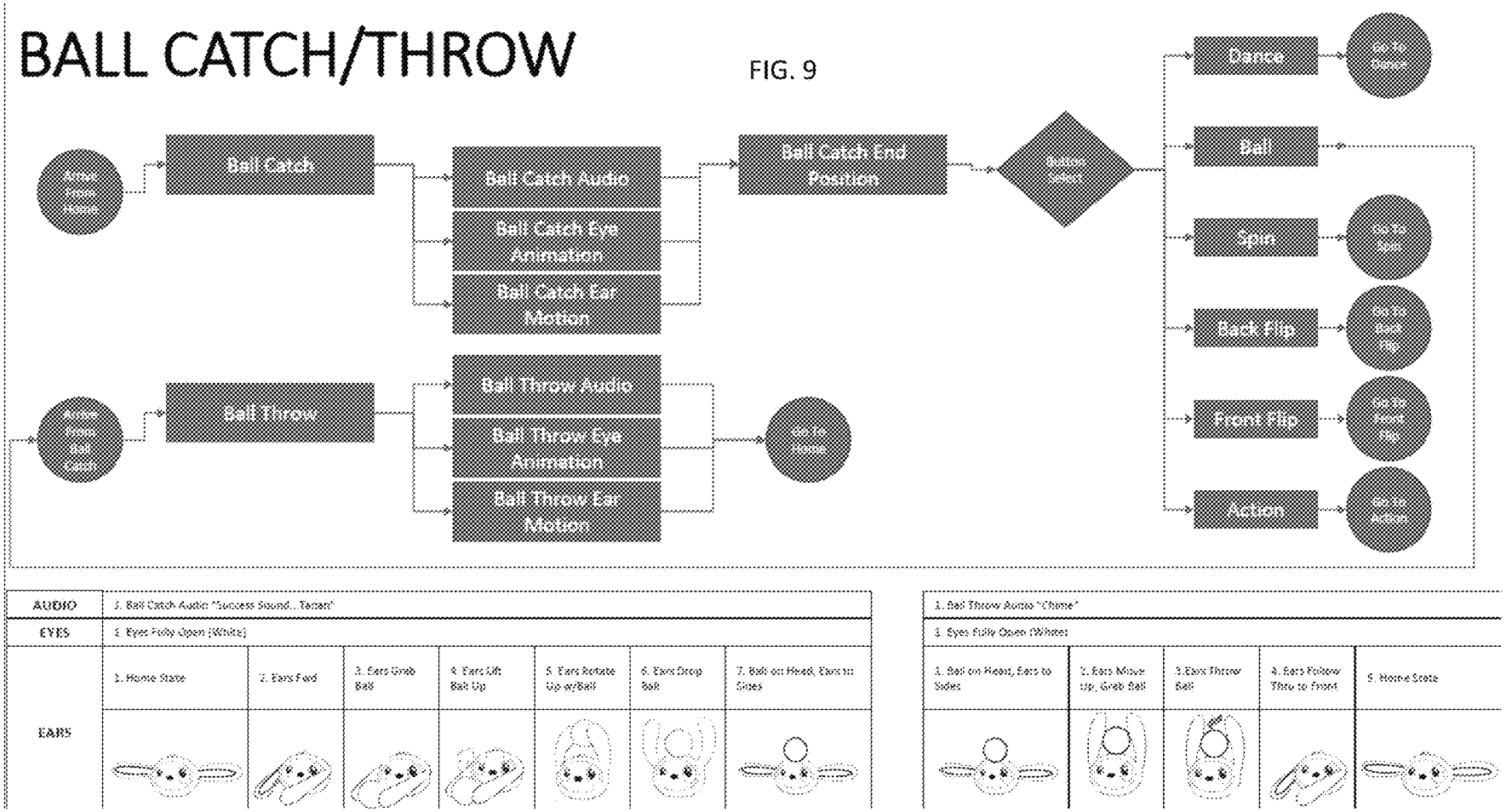
FIG. 9 is a flowchart for Ball Catch/Throw with illustrations.
Figure 11:
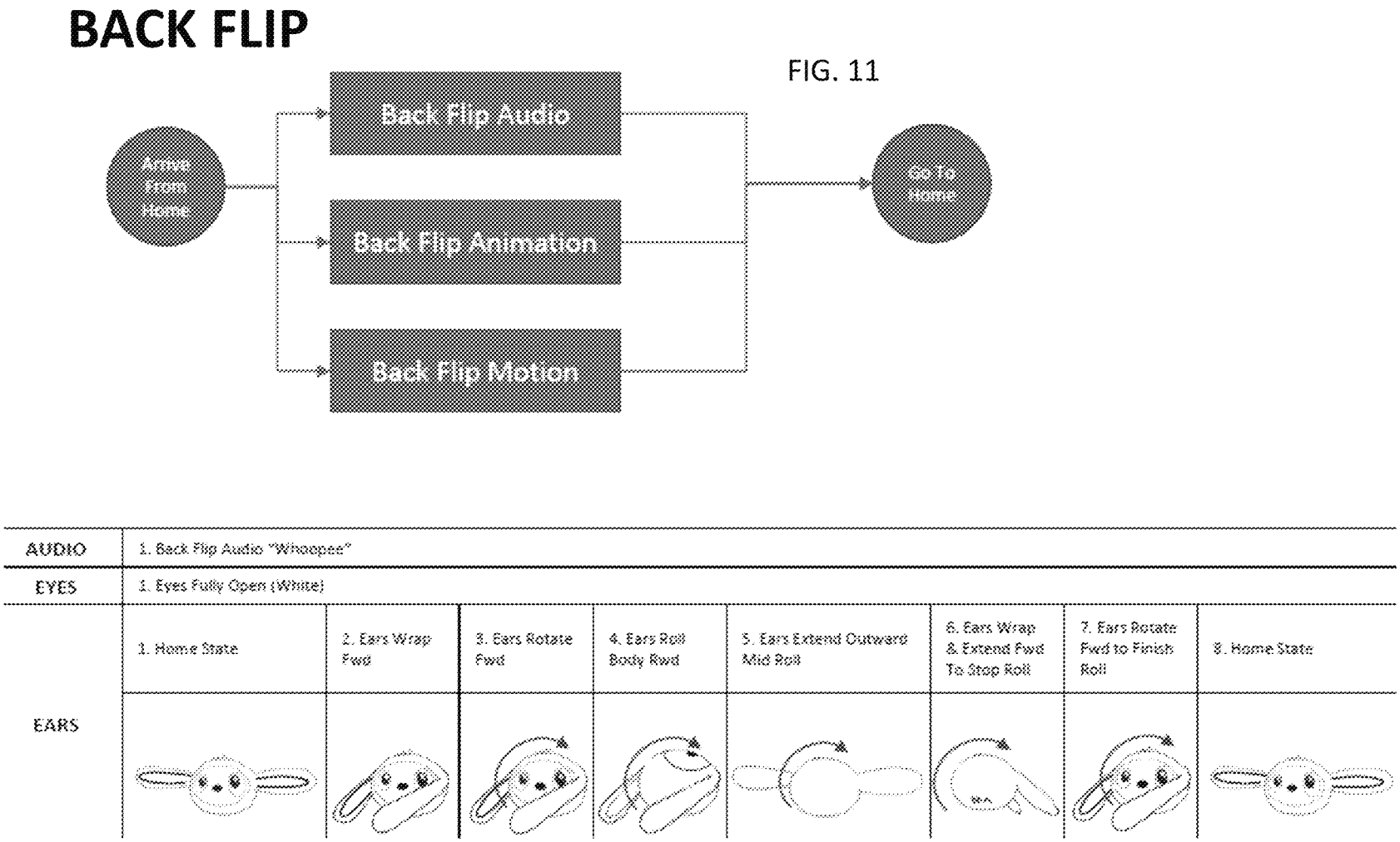
FIG. 11 is a flowchart for Back Flip with illustrations.
Figure 12:
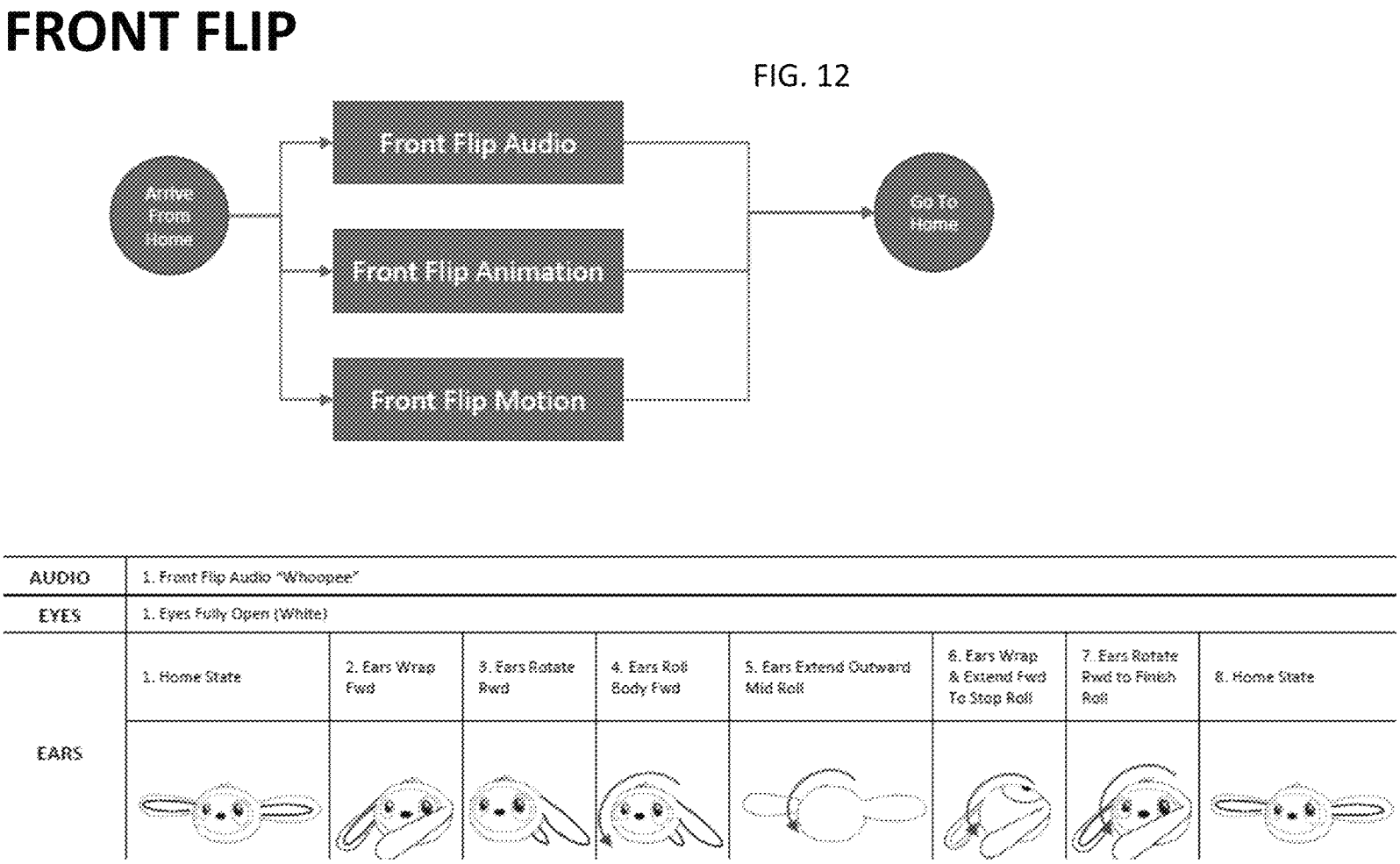
FIG. 12 is a flowchart for Front Flip with illustrations.
Figure 13:
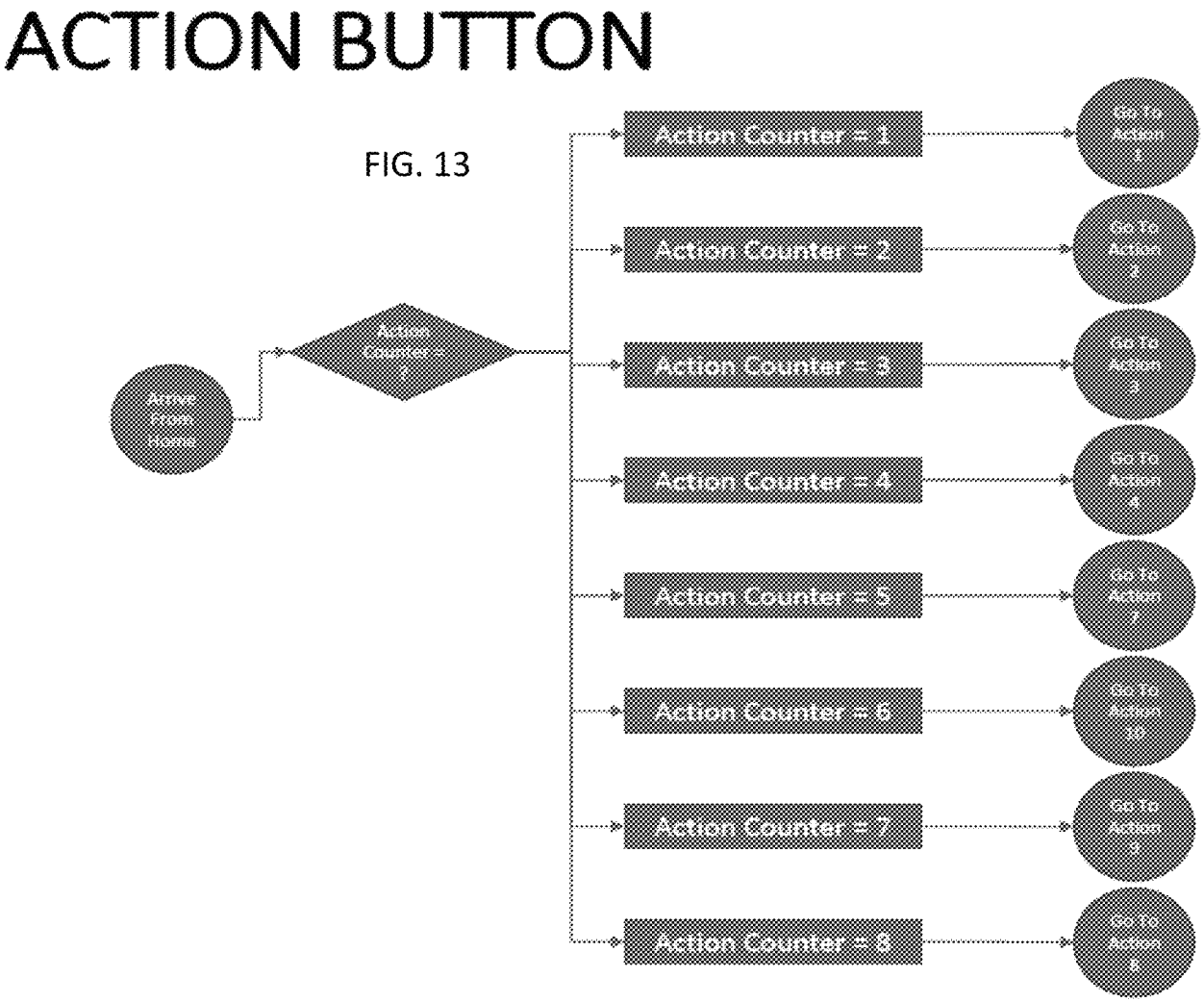
FIG. 13 is a flowchart for the Action Button with eight actions.
Figure 18:
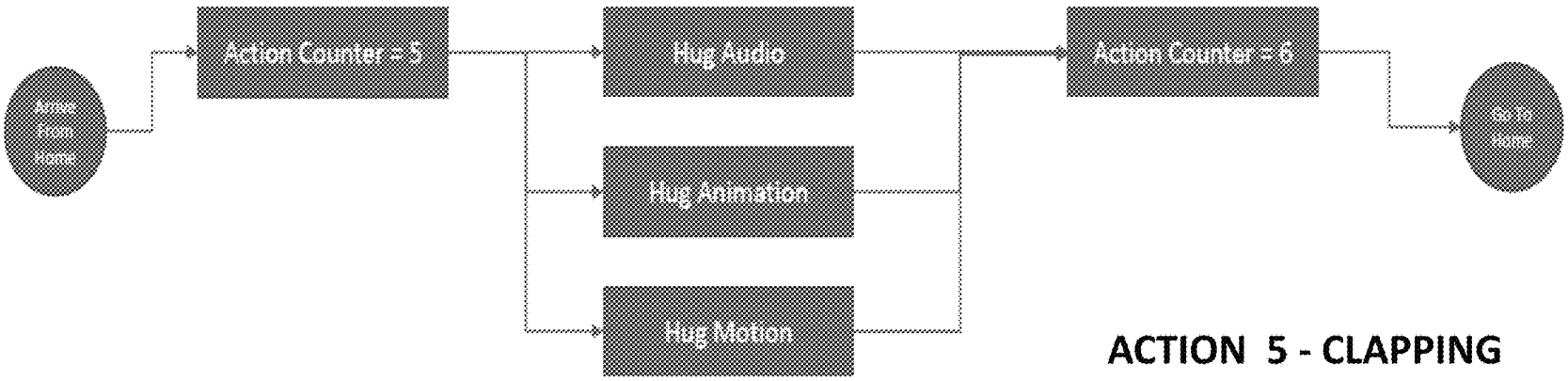
FIG. 18 is a flowchart for Action 5—Clapping with illustrations.
Figure 19:
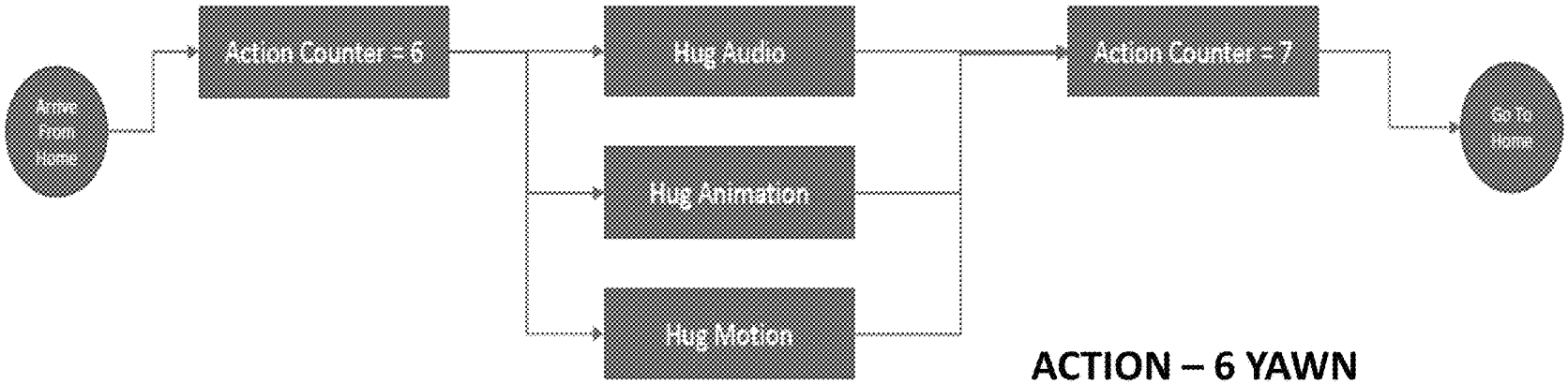
FIG. 19 is a flowchart for Action 6—Yawn with illustrations.

In a preferred embodiment, the extensions 20 are activated by means of a ribbon threaded through and attached to the distal end 54 of the extension and the second reversible drive motor. When tension is applied to the ribbons the extensions bend and animation is produced accordingly. As the child interacts with the toy, it will respond with sound effects and motions including coordinating the positioning and movement of the referenced body parts. In a preferred embodiment, as illustrated in FIG. 5, an interactive, animatronic toy is provided with emotive, animated eyes.

Further interaction is facilitated through a combination of capacitive sensors, microphone, jiggle switch, and accelerometer inputs, allowing the toy to respond to prompts from user with personality-intense reactions emoted via eye animations, voice, body, movement via ears, and interaction with accessory ball.

Additional illuminated facial features may be designed as desired with light or colors that may be used for varying faces, mouth and eyes illumination generating an illusion of animation. A specifically shaped opaque object may be used with translucent surfaces and LEDs, where the eyes themselves are lit up and the rest of the face is dark by selectively lighting internal cavities to change the perceived shape of the eye to cause animation. The batteries are provided internally for powering can be replaceable or provided as rechargeable.

The eyes can function is a variety of ways. They can wink (only closing one eye). They can show confusion (one eye in angry state—⅔ open—and one eye in sad state—⅓ open).

It is to be understood that the embodiments of the invention herein described are merely illustrative of the application of the principles of the invention. From the foregoing, it can be seen that there has been provided a detailed description with various features, and while a particular embodiment of the present invention has been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art

What is claimed is:

1. A mechanical toy comprising:

a body and at least two extensions, wherein the at least two extensions are opposed to each other;

wherein the body has an interior, a front, a back, a top, a bottom, two sides and a bisecting plane between the two sides;

wherein the front, top and back are approximately continuously curved to facilitate rolling;

wherein the bottom is approximately flat to facilitate sitting upright;

wherein located on the two sides are attachment points for the two extensions, one on each side;

wherein the two opposing extensions attachment points form a horizontal axis when the mechanical toy is sitting upright;

wherein the two opposing extensions each have a proximate end located at the attachment point and a distal end;

wherein the distance from proximate end to the distal end of the two opposing extensions is greater than the distance from the attachment point to the bottom, top, back or front of the body;

wherein housed in the interior of the body is a first reversible drive motor having a first drive shaft and a second reversible drive motor having a second drive shaft;

wherein the first reversible drive motor is rotatably attached at the attachment points to the two opposing extensions causing the at least two extensions to rotate along the horizontal axis;

wherein the rotation along the horizontal axis provides locomotion of the mechanical toy;

wherein the second reversible drive motor is coupled to the proximate ends of the two opposing extensions; and wherein the second reversible drive motor provides pivotal manipulation of at least one of the at least two extensions.

2. The mechanical toy of claim 1 wherein a third drive motor is attached to pivot the horizontal axis.

3. The mechanical toy of claim 2 wherein a fourth drive motor is attached to rotate the at least one of the at least two extensions.

4. The mechanical toy of claim 1, wherein the second reversible drive motor provides pivotal manipulation of the at least two extensions.

5. The mechanical toy of claim 4, wherein the pivotal manipulation has a first portion and a second portion wherein the first portion pivots the at least one extension at the attachment point about a perpendicular axis which is perpendicular to the horizontal axis.

6. The mechanical toy of claim 5, wherein the first portion pivots 90 degrees.

7. The mechanical toy of claim 6, wherein the second portion causes the extension to curve toward the bisecting plane.

8. The mechanical toy of claim 1, wherein electronically attached to the first reversible drive motor and the second reversible drive motor is a programmable microprocessor.

9. The mechanical toy of claim 8, wherein the microprocessor is programmed to drive the first reversible drive motor and the second reversible drive motor to provide locomotion and manipulation of the mechanical toy device.

10. A mechanical toy comprising:

a body and at least two extensions, wherein the at least two extensions are opposed to each other;

wherein the body has an interior, a front, a back, a top, a bottom, two sides and a bisecting plane between the two sides;

wherein the front, top and back are approximately continuously curved to facilitate rolling;

wherein the bottom is approximately flat to facilitate sitting upright;

wherein located on the two sides are attachment points for the two extensions, one on each side;

wherein the two opposing extensions attachment points form a horizontal axis when the mechanical toy is sitting upright;

wherein the two opposing extensions each have a proximate end located at the attachment point and a distal end;

wherein the distance from proximate end to the distal end of the two opposing extensions is greater than the distance from the attachment point to the bottom, top or side of the body;

wherein housed in the interior of the body is a first reversible drive motor having a first drive shaft and a second reversible drive motor having a second drive shaft;

wherein the first reversible drive motor is rotatably attached at the attachment points to the two opposing extensions causing the at least two extensions to rotate along the horizontal axis;

wherein the second reversible drive motor is coupled to the proximate ends of the two opposing extensions;

wherein the second reversible drive motor provides pivotal manipulation of at least one of the at least two extensions; and wherein electronically attached to the first reversible drive motor and the second reversible drive motor is a programmable microprocessor.

11. The mechanical toy of claim 10, wherein the at least two opposing extensions can rotate 360 degrees.

12. The mechanical toy of claim 11, wherein a feedback element is electronically attached to the microprocessor and mechanically attached to the first reversible drive motor and the second reversible drive motor; and wherein the feedback element electrically indicates a position of the two opposing extensions to the microprocessor.

13. The mechanical toy of claim 12, wherein the at least two extensions are elongated and flexible.

14. The mechanical toy of claim 12, wherein the at least two extensions are elongated and articulated.

15. The mechanical toy of claim 12, wherein the feedback element is a potentiometer.

16. The mechanical toy of claim 12, wherein the feedback element is a mechanical wiper.

17. A mechanical toy comprising:

a body and at least two extensions, wherein the at least two extensions are opposed to each other;

wherein the body has an interior, a front, a back, a top, a bottom, two sides and a bisecting plane between the two sides;

wherein the front, top and back are approximately continuously curved to facilitate rolling;

wherein the bottom is approximately flat to facilitate sitting upright;

wherein located on the two sides are attachment points for the two extensions, one on each side;

wherein the two opposing extensions attachment points form a horizontal axis when the mechanical toy is sitting upright;

wherein the two opposing extensions each have a proximate end located at the attachment point and a distal end;

wherein the distance from proximate end to the distal end of the two opposing extensions is greater than the distance from the attachment point to the bottom, top or side of the body;

wherein housed in the interior of the body is a first reversible drive motor having a first drive shaft and a second reversible drive motor having a second drive shaft;

wherein the first reversible drive motor is rotatably attached at the attachment points to the two opposing extensions causing the at least two extensions to rotate along the horizontal axis;

wherein the at least two opposing extensions can rotate 360 degrees;

wherein the second reversible drive motor is coupled to the proximate ends of the two opposing extensions;

wherein the second reversible drive motor provides pivotal manipulation with a bilateral motion and a unilateral motion;

wherein the bilateral motion moves the at least two opposing extensions and the unilateral motion moves one of the at least two opposing extensions;

wherein the pivotal manipulation has a first portion and a second portion wherein the first portion pivots the at least one extension at the attachment point about a perpendicular axis which is perpendicular to the horizontal axis;

wherein the second portion causes the extension to curve toward the bisecting plane;

and wherein electronically attached to the first reversible drive motor and the second reversible drive motor is a programmable microprocessor.

18. The mechanical toy of claim 17, wherein a feedback element is electronically attached to the microprocessor and mechanically attached to the first reversible drive motor and the second reversible drive motor;

wherein the feedback element electrically indicates a position of the two opposing extensions to the microprocessor; and wherein the feedback element is a potentiometer or a mechanical wiper.

19. A mechanical toy of claim 18, wherein the at least two extensions are configured to have the appearance of ears.

* * * * *